US010584400B2

(12) United States Patent
Tsugawa et al.

(10) Patent No.: US 10,584,400 B2
(45) Date of Patent: Mar. 10, 2020

(54) COPPER ALLOY WIRE

(71) Applicant: MITSUBISHI MATERIALS CORPORATION, Tokyo (JP)

(72) Inventors: Yasuhiro Tsugawa, Osaka (JP); Toshio Sakamoto, Kitamoto (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 531 days.

(21) Appl. No.: 14/890,116

(22) PCT Filed: May 22, 2014

(86) PCT No.: PCT/JP2014/063564

§ 371 (c)(1),
(2) Date: Nov. 9, 2015

(87) PCT Pub. No.: WO2014/189103

PCT Pub. Date: Nov. 27, 2014

(65) Prior Publication Data

US 2016/0122849 A1 May 5, 2016

(30) Foreign Application Priority Data

May 24, 2013 (JP) ..... 2013-110079
Mar. 28, 2014 (JP) ..... 2014-068368

(51) Int. Cl.

| | |
|---|---|
| ***C22C 9/06*** | (2006.01) |
| ***B22D 11/00*** | (2006.01) |
| ***C22C 9/02*** | (2006.01) |
| ***C22F 1/08*** | (2006.01) |
| ***B22D 21/00*** | (2006.01) |

(52) U.S. Cl.
CPC ..... *C22C 9/06* (2013.01); *B22D 11/005* (2013.01); *B22D 21/005* (2013.01); *C22C 9/02* (2013.01); *C22F 1/08* (2013.01)

(58) Field of Classification Search
CPC ..... C22C 9/00; C22C 9/02; C22C 9/06
See application file for complete search history.

(56) References Cited

U.S. PATENT DOCUMENTS

| | | | |
|---|---|---|---|
| 7,182,823 | B2 | 2/2007 | Mandigo et al. |
| 7,261,951 | B2 | 8/2007 | Takayama et al. |
| 2011/0100676 | A1 | 5/2011 | Oishi et al. |
| 2011/0174417 | A1 | 7/2011 | Oishi |

FOREIGN PATENT DOCUMENTS

| | | | |
|---|---|---|---|
| CN | 1568375 | A | 1/2005 |
| CN | 101568658 | A | 10/2009 |
| CN | 102177265 | A | 9/2011 |
| EP | 2881475 | A | 6/2015 |
| EP | 2881476 | A | 6/2015 |
| JP | 11-189834 | A | 7/1999 |
| JP | 2010-212164 | A | 9/2010 |
| JP | 2014-025136 | A | 2/2014 |
| JP | 2014-025137 | A | 2/2014 |
| JP | 2014-025138 | A | 2/2014 |
| WO | WO-2009/107586 | A | 9/2009 |
| WO | WO-2009/119222 | A | 10/2009 |

OTHER PUBLICATIONS

English machine translation of JP 11-189834 A of Fujiwara at al. published Jul. 13, 1999. (Year: 1999).*
English machine translation of JP 2010-212164 A of Oishi at al. published Sep. 24, 2010. (Year: 2010).*
Nakamoto et al., "Development of High-Performance Copper Alloy Wire on a Continuous Casting and Rolling Process", *Copper and Copper Alloy* (*Journal of Japan Institute of Copper*), 2012, p. 306-310, vol. 51, No. 1.
International Search Report dated Aug. 5, 2014 for the corresponding PCT Application No. PCT/JP2014/063564.
Office Action dated May 30, 2016 for the corresponding Chinese Patent Application No. 201480028620.4.
European Search Report dated Feb. 13, 2017 for the corresponding European Patent Application No. 14800860.0.
Indian Office Action dated Jan. 14, 2020 for the corresponding Indian Patent Application No. 10548/DELNP/2015.

* cited by examiner

*Primary Examiner* — Jophy S. Koshy
(74) *Attorney, Agent, or Firm* — Leason Ellis LLP

(57) ABSTRACT

This copper alloy wire is a copper alloy wire which is made of a precipitation hardening-type copper alloy containing Co, P, and Sn and is manufactured using a continuous cast-rolling method or cold working of a continuous cast wire rod manufactured using a continuous casting method, in which the copper alloy wire has a composition including Co: more than or equal to 0.20 mass % and less than or equal to 0.35 mass %, P: more than 0.095 mass % and less than or equal to 0.15 mass %, and Sn: more than or equal to 0.01 mass % and less than or equal to 0.5 mass % with a balance being Cu and inevitable impurities.

6 Claims, 3 Drawing Sheets

COPPER ALLOY WIRE

CROSS-REFERENCE TO RELATED PATENT APPLICATIONS

This application is a U.S. National Phase Application under 35 U.S.C. § 371 of International Patent Application No. PCT/JP2014/063564, filed May 22, 2014, and claims the benefit of Japanese Patent Applications No. 2013-110079, filed May 24, 2013 and No. 2014-068368, filed Mar. 28, 2013, all of which are incorporated herein by reference in their entireties. The International Application was published in Japanese on Nov. 27, 2014 as International Publication No. WO/2014/189103 under PCT Article 21(2).

FIELD OF THE INVENTION

The present invention relates to a copper alloy wire which is made of a precipitation hardening-type copper alloy containing Co, P, and Sn and is used for, for example, a wire in a vehicle or a device, a trolley wire, a wire for a robot, a wire for an aircraft, and the like.

BACKGROUND OF THE INVENTION

In the related art, for example, as described in Patent Documents 1 and 2, as an electrical wire for wires in a vehicle or a device, an electrical wire obtained by coating an electrical wire conductor, which is formed by twisting a plurality of copper wires together, with an insulating coat is provided. In addition, for efficient wiring or the like, a wire harness obtained by bundling a plurality of the above-described electrical wires is provided.

In recent years, from the viewpoint of environmental protection, there has been a strong demand for a decrease in the weight of a vehicle frame in order to reduce the amount of carbon dioxide discharged from a vehicle. Meanwhile, since there is progress not only in computerization of vehicles but also in the development of hybrid vehicles and electric vehicles, the number of electrical components used in a vehicle is increasing at an accelerating rate. Therefore, the amount of wire harnesses used to connect these components is estimated to be further increasing in the future, and there is a demand for a decrease in the weight of the wire harness.

Here, as means for decreasing the weight of the wire harness, an attempt has been made to decrease the diameters of an electrical wire and a copper wire. In addition, the decrease in the diameters of an electrical wire conductor and a copper wire decreases not only the weight but also the size of the wire harness, and thus there is another advantage in that the wiring space can be effectively used.

In addition, since a trolley wire for a railway, which is used for a train or the like, is in sliding contact with a power collection device such as a pantograph and is fed with power, it is necessary to ensure a certain degree of strength, wear resistance, conductivity, thermal resistance, and the like for the trolley wire.

In recent years, the travelling speed of a train has been increasing; however, when, in a high-speed railway such as Shinkansen, the travelling speed of a train becomes faster than the propagation speed of a wave generated in an overhead wire such as a trolley wire, the contact between the power collection device such as the pantograph and the trolley wire becomes unstable and thus there is a concern that it may become impossible to stably feed power to a train.

Here, since it becomes possible to increase the propagation speed of a wave in the trolley wire by increasing the overhead wire tension of the trolley wire, there is a demand for a trolley wire having a higher strength than before.

As a copper alloy wire having a high strength and a high conductivity which satisfy the above-described demanded characteristics, for example, as disclosed in Patent Documents 1 to 3, copper alloy wires containing Co, P, and Sn have been proposed. In these copper alloy wires, it becomes possible to improve the strength while ensuring the conductivity by precipitating a complex of Co and P in the matrix phase of copper.

CITATION LIST

Patent Document

[Patent Document 1] Japanese Unexamined Patent Application, First Publication No. 2010-212164

[Patent Document 2] Republished Japanese Translation No. 2009/107586 of the PCT International Publication for Patent Applications

[Patent Document 3] Republished Japanese Translation No. 2009/119222 of the PCT International Publication for Patent Applications

Technical Problem

Meanwhile, in a case in which the above-described copper alloy wire containing Co, P, and Sn is manufactured, a method is carried out in which an ingot having a large sectional area called a billet is produced, the billet is hot-extruded through reheating, and then a wire drawing process or the like is further carried out. However, in a case in which a copper alloy is manufactured by carrying out hot extrusion after the production of an ingot having a large sectional area, the length of the copper alloy to be obtained is limited by the size of the ingot, and it has not been possible to obtain a long copper alloy wire. In addition, there has been another problem of poor production efficiency.

Therefore, for example, a method has been proposed in which a copper alloy wire is manufactured using a continuous cast-rolling method in which a belt wheel-type continuous caster or the like is used. In this case, since casting and rolling are continuously carried out, the production efficiency is high and it becomes possible to obtain a long copper alloy wire.

In addition, another method has also been proposed in which a continuous cast wire rod is manufactured using an upward continuous caster, a horizontal continuous caster, and a hot top continuous caster, and the continuous cast wire rod is cold-worked, thereby manufacturing a copper alloy wire.

However, there has been a tendency in the copper alloy wire manufactured using the continuous cast-rolling method in which a belt wheel-type continuous caster or the like is used and the copper alloy wire manufactured through cold working of a continuous cast wire rod for the strength to become low compared with the copper alloy wire manufactured using the manufacturing method including the hot extrusion step of hot-extruding a billet. Therefore, in order to ensure the strength, it is necessary to manufacture a copper alloy wire using the manufacturing method including the hot extrusion step, and it has not been possible to efficiently produce a high-strength copper alloy wire.

The present invention has been made in consideration of the above-described circumstances, and an object of the present invention is to provide a copper alloy wire which is made of a precipitation hardening-type copper alloy containing Co, P, and Sn and is capable of ensuring a sufficient strength even when manufactured using the continuous cast-rolling method or the cold working of a continuous cast wire rod manufactured using a continuous casting method.

SUMMARY OF THE INVENTION

Solution to Problem

In order to solve this problem, the present inventors carried out intensive studies and found that, in a copper alloy wire manufactured using the continuous cast-rolling method, Co and P segregate significantly compared with those in a copper alloy wire manufactured using the manufacturing method including the hot extrusion step. This is assumed to be because, in the case of hot extrusion, an ingot can be heated and held at a high temperature, and it is possible to eliminate the segregation of Co and P; however, in the continuous cast-rolling method, the obtained ingot is immediately rolled and thus it is not possible to sufficiently eliminate segregation which generated in casting. As described above, in a copper alloy wire manufactured using the continuous cast-rolling method, Co and P segregate significantly, and thus the number of precipitates made of a complex of Co and P is insufficient, therefore it is difficult to increase the strength of an end-product. The above-described problems also occur similarly in a copper alloy wire manufactured through the cold working of a continuous cast wire rod.

The present invention has been made on the basis of the above-described finding, and a copper alloy wire of the present invention is a copper alloy wire which is made of a precipitation hardening-type copper alloy containing Co, P, and Sn and is manufactured using a continuous cast-rolling method or the cold working of a continuous cast wire rod manufactured using a continuous casting method, in which the copper alloy wire has a composition including Co: more than or equal to 0.20 mass % and less than or equal to 0.35 mass %, P: more than 0.095 mass % and less than or equal to 0.15 mass %, and Sn: more than or equal to 0.01 mass % and less than or equal to 0.5 mass % with a balance being Cu and inevitable impurities.

The copper alloy wire having the above-described constitution includes relatively large amounts of Co and P (Co: more than or equal to 0.20 mass % and less than or equal to 0.35 mass % and P: more than 0.095 mass % and less than or equal to 0.15 mass %), and thus, even in a case in which Co and P are significantly segregated due to the continuous cast-rolling method or the cold working of a continuous cast wire rod manufactured using the continuous casting method, it is possible to sufficiently precipitate the complex of Co and P, and it becomes possible to improve the strength. Therefore, it becomes possible to efficiently manufacture a high-strength copper alloy wire made of a precipitation hardening-type copper alloy containing Co, P, and Sn using, for example, the continuous cast-rolling method or the cold working of a continuous cast wire rod manufactured using the continuous casting method.

Here, in the copper alloy wire of the present invention, the atomic ratio Co/P of Co to P is preferably set in a range of $1.2 \leq Co/P \leq 1.7$.

In this case, since the atomic ratio Co/P of Co to P is set to $Co/P \geq 1.2$, the amount of Co is sufficiently ensured, and the number of precipitates made of the complex of Co and P can be ensured. In addition, since the atomic ratio Co/P of Co to P is set to $Co/P \leq 1.7$, the amount of P is sufficiently ensured, and the number of precipitates made of the complex of Co and P can be ensured. Meanwhile, when $Co_2P$ is used as the complex of Co and P constituting the precipitates, the atomic ratio Co/P of Co to P reaches 2; however, in a case in which Co and P significantly segregate, the amount of P contained in the complex is greater than the theoretical amount, and thus it becomes possible to ensure the number of precipitates made of the complex ($Co_2P$) of Co and P.

In addition, the copper alloy wire of the present invention preferably further includes one or more elements selected from a group consisting of Ni: more than or equal to 0.01 mass % and less than or equal to 0.15 mass % and Fe: more than or equal to 0.005 mass % and less than or equal to 0.07 mass %.

In this case, it is possible to miniaturize the complex of Co and P using Ni and Fe and to further improve the strength.

In addition, the copper alloy wire of the present invention preferably further includes one or more elements selected from a group consisting of Zn: more than or equal to 0.002 mass % and less than or equal to 0.5 mass %, Mg: more than or equal to 0.002 mass % and less than or equal to 0.25 mass %, Ag: more than or equal to 0.002 mass % and less than or equal to 0.25 mass %, and Zr: more than or equal to 0.001 mass % and less than or equal to 0.1 mass %.

In this case, it is possible to detoxify S, which is mixed in a recycling process of a copper material, using Zn, Mg, Ag, and Zr, intermediate temperature embrittlement is prevented, and it is possible to improve the strength and ductility of the copper alloy wire.

Furthermore, in the copper alloy wire of the present invention, the atomic ratio (Co+P)/Sn is preferably set in a range of $3.5 \leq (Co+P)/Sn \leq 8.5$.

In this case, it is possible to optimize the balance between precipitation hardening using a precipitate made of the complex of Co and P and solid solution hardening using the solid solution of Sn by carrying out control so that the atomic ratio of (Co+P) to Sn is in the above-described range.

Advantageous Effects of Invention

According to the present invention, it becomes possible to provide a copper alloy wire which is made of a precipitation hardening-type copper alloy containing Co, P, and Sn and is capable of ensuring a sufficient strength even when manufactured using the continuous cast-rolling method or the cold working of a continuous cast wire rod manufactured using the continuous casting method.

DETAILED DESCRIPTION OF THE INVENTION

Figure 1:
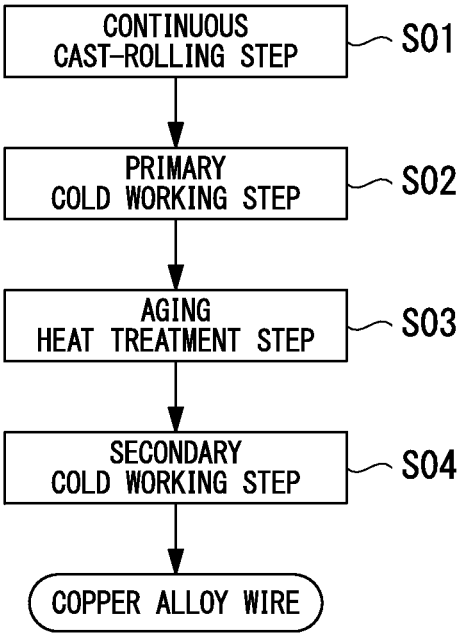
FIG. 1 is a flowchart showing a manufacturing method for manufacturing a copper alloy wire which is an embodiment of the present invention.

Hereinafter, a copper alloy wire according to an embodiment of the present invention will be described with reference to the accompanying drawings.

The copper alloy wire which is the present embodiment is a copper alloy wire which is made of a precipitation hardening-type copper alloy containing Co, P, and Sn and is manufactured using a continuous cast-rolling method or cold working of a continuous cast wire rod manufactured using a continuous casting method, in which the copper alloy wire has a composition including Co: more than or equal to 0.20 mass % and less than or equal to 0.35 mass %, P: more than 0.095 mass % and less than or equal to 0.15 mass %, and Sn: more than or equal to 0.01 mass % and less than or equal to 0.5 mass % with a balance being Cu and inevitable impurities. In addition, in the present embodiment, the atomic ratio Co/P of Co to P is set in a range of $1.2 \leq Co/P \leq 1.7$. Furthermore, in the present embodiment, the atomic ratio (Co+P)/Sn is set to be in a range of $3.5 \leq (Co+P)/Sn \leq 8.5$.

Meanwhile, the copper alloy wire may further include one or more elements selected from a group consisting of Ni: more than or equal to 0.01 mass % and less than or equal to 0.15 mass % and Fe: more than or equal to 0.005 mass % and less than or equal to 0.07 mass %.

In addition, the copper alloy wire may further include one or more elements selected from a group consisting of Zn: more than or equal to 0.002 mass % and less than or equal to 0.5 mass %, Mg: more than or equal to 0.002 mass % and less than or equal to 0.25 mass %, Ag: more than or equal to 0.002 mass % and less than or equal to 0.25 mass %, and Zr: more than or equal to 0.001 mass % and less than or equal to 0.1 mass %.

Hereinafter, the reasons for setting the contents of the respective elements in the above-described ranges will be described.

(Co)

Co is an element that forms, together with P, a precipitate which disperses in the matrix phase of copper.

Here, in a case in which the amount of Co is less than 0.20 mass %, the number of precipitates is insufficient, and there is a concern that it may be impossible to sufficiently improve the strength. On the other hand, in a case in which the amount of Co exceeds 0.35 mass %, a number of elements not contributing to the improvement of the strength are present, and there is a concern that a decrease in the conductivity and the like may be caused.

Therefore, in the present embodiment, the amount of Co is set in a range of more than or equal to 0.20 mass % and less than or equal to 0.35 mass %.

The amount of Co is more desirably in a range of more than or equal to 0.27 mass % and less than or equal to 0.33 mass %.

(P)

P is an element that forms, together with Co, a precipitate which disperses in the matrix phase of copper.

In a case in which the copper alloy wire is manufactured using the continuous cast-rolling method, Co and P significantly segregate, and thus, when the amount of P is not great, there is a concern that the amount of a complex of Co and P may be insufficient. Therefore, in a case in which the amount of P is 0.095 mass % or less, the number of precipitates is insufficient, and there is a concern that it may be impossible to sufficiently improve the strength. On the other hand, in a case in which the amount of P exceeds 0.15 mass %, there is a concern that a decrease in the conductivity and the like may be caused.

Therefore, in the present embodiment, the amount of P is set in a range of more than 0.095 mass % and less than or equal to 0.15 mass %.

The amount of P is more desirably in a range of more than or equal to 0.095 mass % and less than or equal to 0.12 mass %.

(Atomic Ratio Co/P of Co to P)

As described above, Co and P form a precipitate made of a complex of Co and P. Here, in a case in which the atomic ratio Co/P of Co to P is less than 1.2, the amount of Co is insufficient, and there is a concern that it may be impossible to sufficiently ensure the number of the precipitates made of the complex of Co and P. On the other hand, in a case in which the atomic ratio Co/P of Co to P exceeds 1.7, the amount of P is insufficient, and there is a concern that it may be impossible to sufficiently ensure the number of the precipitates made of the complex of Co and P.

Therefore, in the present embodiment, the atomic ratio Co/P of Co to P is set in a range of $1.2 \leq Co/P \leq 1.7$.

Meanwhile, as the precipitate made of the complex of Co and P, $Co_2P$ can be used. In the present embodiment, the atomic ratio Co/P of Co to P is set to be in a range of $1.2 \leq Co/P \leq 1.7$, and the amount of P contained in the complex is greater compared with the theoretical atomic ratio Co/P of $Co_2P$ which is 2.

In a case in which Co and P significantly segregate, since an excessive amount of P is contained, it becomes possible to ensure the number of the precipitates made of the complex of Co and P.

The atomic ratio Co/P of Co to P is more desirably in a range of $1.3 \leq Co/P \leq 1.6$.

(Sn)

Sn is an element having an action in which Sn forms a solid solution in the matrix phase of copper so as to improve the strength. In addition, Sn also has an effect of accelerating the precipitation of a precipitate containing Co and P as main components and an action of improving thermal resistance and corrosion resistance.

Here, in a case in which the amount of Sn is less than 0.01 mass %, there is a concern that it may be impossible to reliably exhibit the above-described action and effect. On the other hand, in a case in which the amount of Sn exceeds 0.5 mass %, there is a concern that it may be impossible to ensure the conductivity.

Therefore, in the present embodiment, the amount of Sn is set in a range of more than or equal to 0.01 mass % and less than or equal to 0.5 mass %.

The amount of Sn is more desirably in a range of more than or equal to 0.15 mass % and less than or equal to 0.3 mass %. In this range, it is possible to obtain a favorable strength-conductivity balance. Meanwhile, in a case in which the amount of Sn is set to be in a range of more than or equal to 0.3 mass % and less than or equal to 0.5 mass %, it is possible to significantly improve the strength.

(Atomic Ratio (Co+P)/Sn)

As described above, Co and P form the precipitate made of the complex of Co and P and thus contribute to precipitation hardening. Meanwhile, Sn forms a solid solution in the matrix phase and thus contributes to solid solution hardening. Therefore, it becomes possible to optimize the balance between precipitation hardening and solid solution hardening by controlling (Co+P)/Sn.

Here, in a case in which (Co+P)/Sn is less than 3.5, the solid solution hardening by Sn becomes dominant, and an attempt to improve the strength decreases the conductivity, and thus there is a limitation in the improvement of the strength in use requiring a high conductivity. On the other hand, in a case in which (Co+P)/Sn exceeds 8.5, the precipitation hardening by the complex of Co and P becomes dominant, and the strength improvement effect is saturated from the viewpoint of the precipitation state (the size of precipitate particles and precipitation uniformity) of the complex. In addition, in a case in which the copper alloy wire is used in a high temperature environment, there is a concern that the strength and the like may change.

Therefore, in the present embodiment, (Co+P)/Sn is set in a range of $3.5 \leq (Co+P)/Sn \leq 8.5$. (Co+P)/Sn is more desirably in a range of $5 \leq (Co+P)/Sn \leq 7$.

(Ni and Fe)

Ni and Fe are elements having an action effect of miniaturizing the precipitates made of the complex of Co and P.

Here, in a case in which the amount of Ni is less than 0.01 mass % or a case in which the amount of Fe is less than 0.005 mass %, there is a concern that it may be impossible to reliably exhibit the above-described action effect. On the other hand, in a case in which the amount of Ni exceeds 0.15 mass % or a case in which the amount of Fe exceeds 0.07 mass %, there is a concern that it may be impossible to ensure the conductivity.

Therefore, in a case in which Ni is contained, the amount of Ni is preferably set in a range of more than or equal to 0.01 mass % and less than or equal to 0.15 mass %, and in a case in which Fe is contained, the amount of Fe is preferably set in a range of more than or equal to 0.005 mass % and less than or equal to 0.07 mass %.

(Zn, Mg, Ag, and Zr)

Elements such as Zn, Mg, Ag, and Zr are elements that generate a complex with S and have an action effect of limiting the solid solution of S in the matrix phase of copper.

Here, in a case in which the contents of the elements of Zn, Mg, Ag, and Zr are respectively less than the above-described lower limit values, it is not possible to sufficiently exhibit the action effect of limiting the solid solution of S in the matrix phase of copper. On the other hand, in a case in which the contents of the elements of Zn, Mg, Ag, and Zr respectively exceed the above-described upper limit values, there is a concern that it may become impossible to ensure the conductivity.

Therefore, in a case in which the elements of Zn, Mg, Ag, and Zr are contained, the contents thereof are preferably set in the above-described ranges respectively.

Next, a method for manufacturing the above-described copper alloy wire will be described. FIG. 1 shows a flowchart of the method for manufacturing a copper alloy wire which is the embodiment of the present invention.

First, a copper wire rod 50 made of a copper alloy having the above-described composition is continuously produced using a continuous cast-rolling method (continuous cast-rolling step S01). In this continuous cast-rolling step S01, for example, the continuous cast-rolling facility shown in FIG. 2 is used.

Figure 2:
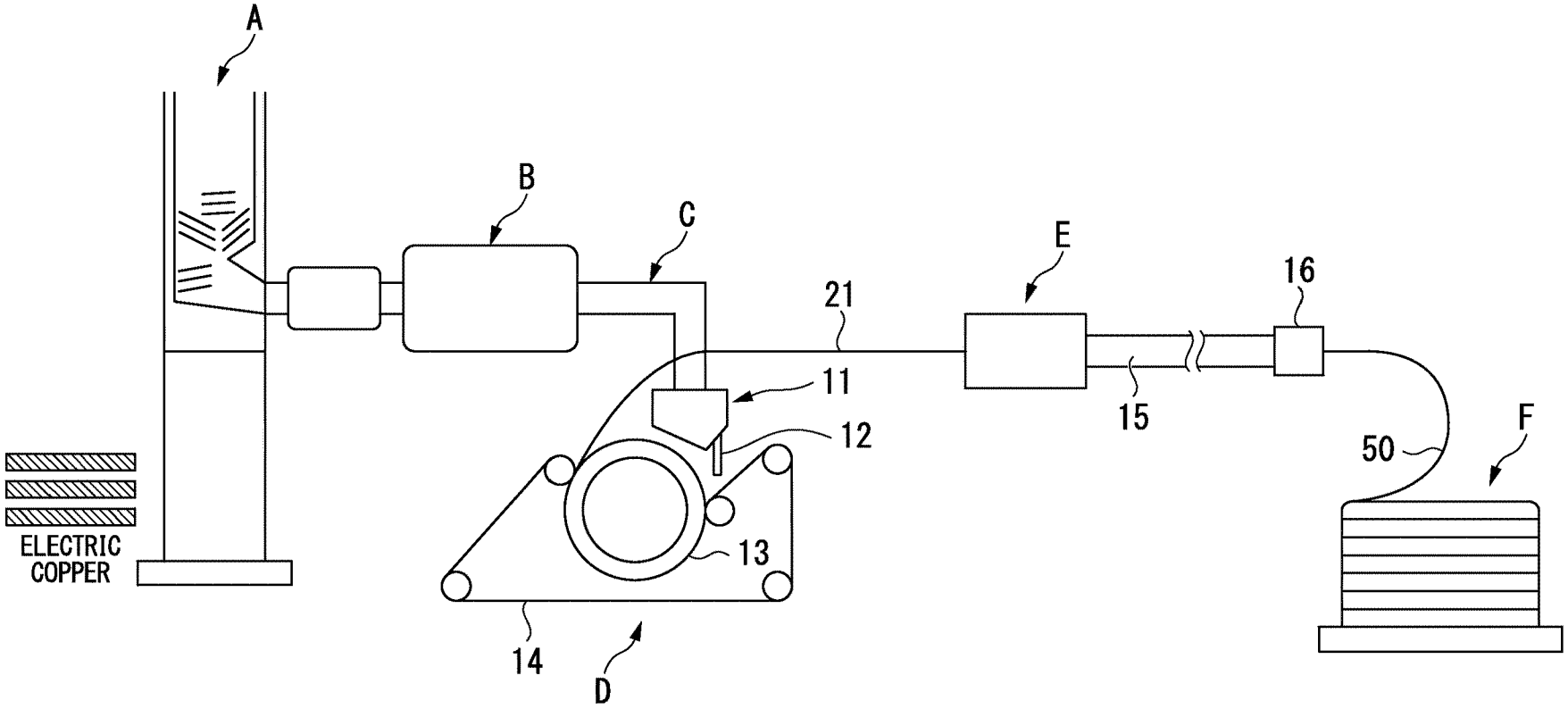
FIG. 2 is a schematic explanatory view of a continuous cast-rolling facility used in the manufacturing method shown in FIG. 1.

The continuous cast-rolling facility shown in FIG. 2 has a melting furnace A, a holding furnace B, a casting launder C, a belt wheel-type continuous caster D, a continuous rolling mill E, and a coiler F.

As the melting furnace A, in the present embodiment, a shaft furnace having a cylindrical furnace main body is used.

In the lower portion of the furnace main body, a plurality of burners (not shown) is disposed in the circumferential direction in a multistep pattern in the vertical direction. In addition, electrolytic copper, which is a raw material, is charged from the upper portion of the furnace main body and is melted through the combustion of the burners, and molten copper is continuously produced.

The holding furnace B is a furnace for temporarily storing the molten copper produced in the melting furnace A while holding the molten copper at a predetermined temperature and for sending a certain amount of the molten copper to the casting launder C.

The casting launder C is a tube for transferring the molten copper sent from the holding furnace B to a tundish 11 disposed above the belt wheel-type continuous caster D. The casting launder C is sealed with, for example, an inert gas such as Ar or a reducing gas. Meanwhile, the casting launder C is provided with degassing device (not shown) for removing oxygen and the like in the molten metal by stirring the molten copper using the inert gas.

The tundish 11 is a storage tank provided to continuously supply the molten copper to the belt wheel-type continuous caster D. A pouring nozzle 12 is disposed in the tundish 11 on the end side in the flow direction of the molten copper, and the molten copper in the tundish 11 is supplied to the belt wheel-type continuous caster D through the pouring nozzle 12.

Here, in the present embodiment, alloy element addition device (not shown) is provided in the casting launder C and the tundish 11, and the above-described elements (Co, P, Sn, and the like) are added to the molten copper.

The belt wheel-type continuous caster D has a casting wheel 13 having grooves formed on the outer circumferential surface and an endless belt 14 being revolved around the casting wheel so as to come into contact with a part of the outer circumferential surface of the casting wheel 13. In the belt wheel-type continuous caster D, the molten copper is injected through the pouring nozzle 12 into spaces formed between the grooves and the endless belt 14, and the molten copper is cooled and solidified, thereby continuously casting a rod-shaped ingot 21.

The continuous rolling mill E is coupled to the downstream side of the belt wheel-type continuous caster D.

The continuous rolling mill E continuously rolls the ingot 21 produced from the belt wheel-type continuous caster D so as to produce the copper wire rod 50 having a predetermined outer diameter.

The copper wire rod 50 produced from the continuous rolling mill E is wound around the coiler F through a washing and cooling device 15 and a flaw detector 16.

Here, the outer diameter of the copper wire rod 50 produced using the above-described continuous cast-rolling facility is set, for example, in a range of 8 mm to 40 mm, and, in the present embodiment, is set to 25 mm.

Next, cold working is carried out on the copper wire rod 50 produced through the continuous cast-rolling step S01 as shown in FIG. 1 (primary cold working step S02). In this primary cold working step S02, working is carried out at multiple steps, and a copper wire material having an outer diameter in a range of 1.0 mm to 30 mm is produced. In the present embodiment, a copper wire material having an outer diameter of 18 mm is produced.

Next, an aging heat treatment is carried out on the copper wire material after the primary cold working step S02 (aging heat treatment step S03). Through this aging heat treatment step S03, a precipitate made of a complex containing Co and P as main components is precipitated.

Here, in the aging heat treatment step S03, the aging heat treatment is carried out under conditions of a thermal treatment temperature in a range of 200° C. to 700° C. and a holding time in a range of 1 hour to 30 hours.

Next, cold working is carried out on the copper wire material after the aging heat treatment step S03, thereby producing a copper alloy wire having a predetermined sectional shape (secondary cold working step S04).

In this secondary cold working step S04, working is carried out at multiple steps, and the copper alloy wire having an outer diameter in a range of 0.01 mm to 20 mm is produced. The outer diameter of the copper alloy wire of the present embodiment is set to 12 mm.

Through the above-described steps, the copper alloy wire, which is the present embodiment, is manufactured.

According to the copper alloy wire having the above-described constitution, which is the present embodiment, since the copper alloy wire includes relatively large amounts of Co and P (Co: more than or equal to 0.20 mass % and less than or equal to 0.35 mass % and P: more than 0.095 mass % and less than or equal to 0.15 mass %), even in a case in which the copper alloy wire is manufactured using the continuous cast-rolling device shown in FIG. 2, and Co and P are significantly segregated, it is possible to sufficiently precipitate the complex ($Co_2P$) of Co and P, and the improvement of the strength is possible. Therefore, it becomes possible to efficiently manufacture a high-strength copper alloy wire made of a precipitation hardening-type copper alloy containing Co, P, and Sn using the continuous cast-rolling method.

In addition, in the present embodiment, since the atomic ratio Co/P of Co to P is set in a range of $1.2 \leq Co/P \leq 1.7$, the amount of Co and the amount of P are respectively ensured, it is possible to ensure the number of the precipitates made of the complex of Co and P, and the improvement of the strength is possible. Particularly, in the present embodiment, since the amount of P contained in the complex is greater than the theoretical atomic ratio Co/P of $Co_2P$ which is 2, even in a case in which Co and P significantly segregate, it is possible to ensure the number of the precipitates made of the complex of Co and P, and the strength can be reliably improved.

Furthermore, in the present embodiment, since the atomic ratio (Co+P)/Sn is set in a range of $3.5 \leq (Co+P)/Sn \leq 8.5$, it becomes possible to optimize the balance between the precipitation hardening by the complex of Co and P and the solid solution hardening by Sn. Therefore, it is possible to increase both the strength and the conductivity, and, even in a case in which the copper alloy wire is used in a high temperature environment, it is possible to stabilize the characteristics such as strength and conductivity.

In addition, in the present embodiment, in a case in which the copper alloy wire further includes one or more elements selected from a group consisting of Ni: more than or equal to 0.01 mass % and less than or equal to 0.15 mass % and Fe: more than or equal to 0.005 mass % and less than or equal to 0.07 mass %, it is possible to miniaturize the complex of Co and P using Ni and Fe and to further improve the strength.

In addition, in the present embodiment, in a case in which the copper alloy wire further includes one or more elements selected from a group consisting of Zn: more than or equal to 0.002 mass % and less than or equal to 0.5 mass %, Mg: more than or equal to 0.002 mass % and less than or equal to 0.25 mass %, Ag: more than or equal to 0.002 mass % and less than or equal to 0.25 mass %, and Zr: more than or equal to 0.001 mass % and less than or equal to 0.1 mass %, it is possible to detoxify S, which is mixed in a recycling process of a copper material, using Zn, Mg, Ag, and Zr, intermediate temperature embrittlement is prevented, and it is possible to improve the strength and ductility of the copper alloy wire.

Thus far, the copper alloy wire, which is the present embodiment of the present invention, has been described, but the present invention is not limited thereto, and can be appropriately modified within the scope of the technical concept of the present invention.

For example, in the above-described embodiment, as an example of the method for manufacturing the copper alloy wire, the method in which the belt wheel-type continuous caster shown in FIG. 2 is used has been described, but the method is not limited thereto, and a twin belt-type continuous cast-rolling mill or the like may be used.

Furthermore, the copper alloy wire may be manufactured by manufacturing a continuous cast wire rod using an upward continuous caster, a horizontal continuous caster, and a hot top continuous caster, and cold-working the continuous cast wire rod.

In addition, in the present embodiment, the copper alloy wire manufactured using the manufacturing method shown in the flowchart of FIG. 1 has been described, but the manufacturing method is not limited thereto, and, for example, a final thermal treatment step may be carried out after the secondary cold working step. In addition, the secondary cold working step may not be carried out.

EXAMPLES

Hereinafter, the results of a confirmation test carried out to confirm the effectiveness of the present invention will be described.

Example 1

Examples of Present Invention 1 to 13 and Comparative Examples 1 to 5

Copper wire rods (with an outer diameter of 25 mm) made of a copper alloy having a composition shown in Table 1 were produced using a continuous cast-rolling facility provided with a belt wheel-type continuous caster. Primary cold working was carried out on these copper wire rods so as to reduce the outer diameter to 18 mm, and then an aging heat treatment was carried out under conditions shown in Table 2. After that, secondary cold working was carried out, thereby reducing the outer diameter to 12 mm.

(Conventional Example)

A billet having an outer diameter of 240 mm made of a copper alloy having a composition shown in Table 1 was prepared, and was reheated to 950° C., thereby carrying out hot extrusion. Primary cold working was carried out on the obtained extruded material so as to reduce the outer diameter to 18 mm, and then an aging heat treatment was carried out under conditions shown in Table 2. After that, secondary cold working was carried out, thereby reducing the outer diameter to 12 mm.

The tensile strengths and conductivities of the copper alloy wires obtained as described above were evaluated as described below.

The tensile strength was measured by carrying out a tensile test using an AG-100kNZ manufactured by Shimadzu Corporation according to JIS Z 2241 (in conformity with ISO 6892-1). The results are shown in Table 2.

The conductivity was measured using a double bridge method according to JIS H 0505. In detail, the conductivity was obtained by measuring the electrical resistance of a test specimen having an outer diameter of 12 mm and a length of 350 mm at 20° C. using a double bridge-type resistance measurement instrument (275200 manufactured by Yokogawa Electric Corporation), computing the conductance using an average section method, and expressing the percentage of the conductance with respect to the conductance of the standard annealed copper (the standard annealed copper regulated by International Electrotechnical Commission (ICE)).

The evaluation results are shown in Table 2.

In addition, in the Conventional Example, a 5 mm×5 mm observation specimen was taken from the sectional center portion of the hot extruded material obtained through hot extrusion, and the line analyses of Co and P were carried out through EPMA analyses.

Figure 3:
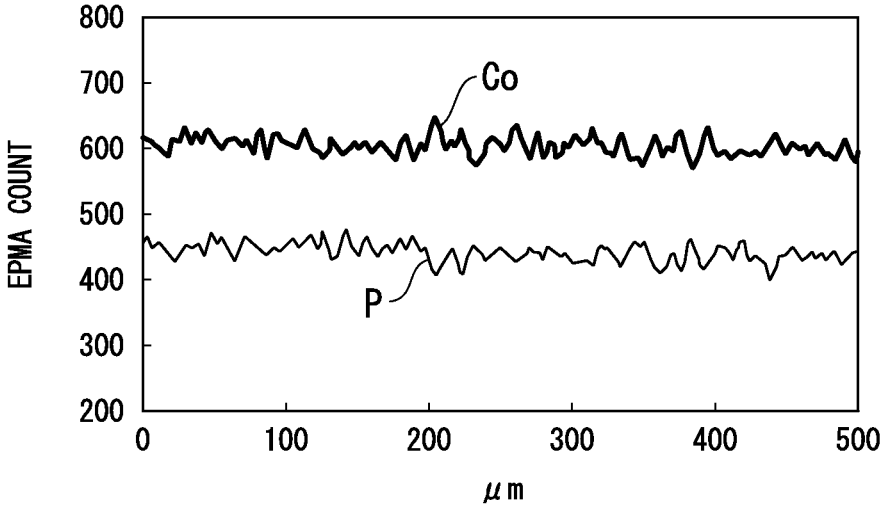
FIG. 3 is a view showing the line analysis results of Co and P in a Conventional Example.

The results are shown in FIG. 3.

Furthermore, in Example of Present Invention 1, a 5 mm×5 mm observation specimen was taken from the sectional center portion of an intermediate rolled material in the continuous cast-rolling step, and the line analyses of Co and P were carried out through EPMA analyses.

Figure 4:
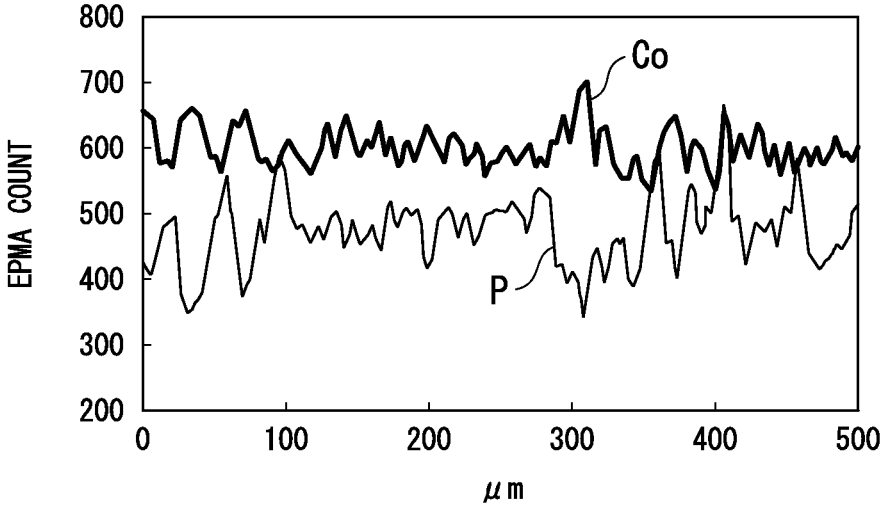
FIG. 4 is a view showing the line analysis results of Co and P in Example of Present Invention 1.

The results are shown in FIG. 4.

TABLE 1

| | | Alloy component composition | | | | | | | | | | | |
|---|---|---|---|---|---|---|---|---|---|---|---|---|---|
| | | Co mass % | P mass % | Sn mass % | Co/P Atomic ratio | (Co + P)/Sn Atomic ratio | Ni mass % | Fe mass % | Zn mass % | Mg mass % | Ag mass % | Zr mass % | Cu |
| Examples of Present Invention | 1 | 0.251 | 0.109 | 0.063 | 1.210 | 14.658 | — | — | — | — | — | — | Balance |
| | 2 | 0.248 | 0.106 | 0.081 | 1.230 | 11.184 | — | — | — | — | — | — | Balance |
| | 3 | 0.267 | 0.107 | 0.090 | 1.311 | 10.533 | — | — | — | — | — | — | Balance |
| | 4 | 0.236 | 0.136 | 0.053 | 0.912 | 18.806 | — | — | — | — | — | — | Balance |
| | 5 | 0.318 | 0.097 | 0.086 | 1.723 | 11.772 | — | — | — | — | — | — | Balance |
| | 6 | 0.311 | 0.133 | 0.081 | 1.229 | 14.028 | 0.041 | — | 0.048 | — | — | — | Balance |
| | 7 | 0.242 | 0.099 | 0.039 | 1.285 | 22.230 | 0.144 | 0.049 | — | 0.160 | — | — | Balance |
| | 8 | 0.229 | 0.096 | 0.047 | 1.254 | 17.644 | 0.138 | 0.030 | — | — | 0.236 | — | Balance |
| | 9 | 0.297 | 0.128 | 0.057 | 1.219 | 19.104 | — | 0.065 | — | — | — | 0.027 | Balance |
| | 10 | 0.215 | 0.103 | 0.412 | 1.100 | 2.030 | — | — | — | — | — | — | Balance |
| | 11 | 0.220 | 0.137 | 0.462 | 0.846 | 2.117 | — | — | — | — | — | — | Balance |
| | 12 | 0.342 | 0.100 | 0.473 | 1.802 | 2.291 | — | — | — | — | — | — | Balance |
| | 13 | 0.338 | 0.141 | 0.470 | 1.263 | 2.626 | — | — | — | — | — | — | Balance |
| Comparative Examples | 1 | 0.185 | 0.107 | — | 0.909 | — | — | — | — | — | — | — | Balance |
| | 2 | 0.263 | 0.087 | — | 1.589 | — | — | — | — | — | — | — | Balance |
| | 3 | 0.307 | 0.156 | — | 1.034 | — | — | — | — | — | — | — | Balance |
| | 4 | 0.311 | 0.113 | 0.005 | 1.446 | 211.924 | — | — | — | — | — | — | Balance |
| | 5 | 0.264 | 0.103 | 0.631 | 1.347 | 1.468 | — | — | — | — | — | — | Balance |
| Conventional Example | | 0.278 | 0.084 | 0.041 | 1.739 | 21.512 | 0.046 | — | 0.017 | — | — | — | Balance |

TABLE 2

| | | Step | | | Evaluation | |
|---|---|---|---|---|---|---|
| | | | Aging heat treatment | | Tensile | |
| | | | Temperature ° C. | Time min. | strength MPa | Conductivity % IACS |
| Example of Present Invention | 1 | Continuous cast-rolling | 500 | 4 | 564 | 80 |
| | 2 | Continuous cast-rolling | 500 | 4 | 565 | 80 |
| | 3 | Continuous cast-rolling | 500 | 4 | 565 | 81 |
| | 4 | Continuous cast-rolling | 500 | 4 | 559 | 79 |
| | 5 | Continuous cast-rolling | 500 | 4 | 554 | 79 |
| | 6 | Continuous cast-rolling | 500 | 4 | 567 | 79 |
| | 7 | Continuous cast-rolling | 500 | 4 | 566 | 80 |
| | 8 | Continuous cast-rolling | 500 | 4 | 568 | 80 |
| | 9 | Continuous cast-rolling | 500 | 4 | 570 | 79 |
| | 10 | Continuous cast-rolling | 500 | 4 | 568 | 77 |
| | 11 | Continuous cast-rolling | 500 | 4 | 570 | 77 |
| | 12 | Continuous cast-rolling | 500 | 4 | 581 | 76 |
| | 13 | Continuous cast-rolling | 500 | 4 | 584 | 77 |
| Comparative Examples | 1 | Continuous cast-rolling | 500 | 4 | 515 | 76 |
| | 2 | Continuous cast-rolling | 500 | 4 | 524 | 78 |
| | 3 | Continuous cast-rolling | 500 | 4 | 566 | 69 |
| | 4 | Continuous cast-rolling | 500 | 4 | 530 | 81 |
| | 5 | Continuous cast-rolling | 500 | 4 | 580 | 63 |
| Conventional Example | | Hot extrusion | 500 | 4 | 565 | 81 |

In Comparative Examples 1 and 2 in which the contents of Co and P were smaller than the range of the present invention, the tensile strengths were insufficient. This was assumed to be because the precipitates of Co and P were not sufficiently dispersed.

In Comparative Example 3 in which the contents of Co and P were greater than the range of the present invention, the conductivity was low.

In Comparative Example 4 in which the amount of Sn was smaller than the range of the present invention, the tensile strength was insufficient. This was assumed to be because the solid solution hardening by Sn was insufficient.

In Comparative Example 5 in which the amount of Sn was greater than the range of the present invention, the conductivity was low.

In contrast, in Examples of Present Invention 1 to 13 in which the contents of Co, P, and Sn were in the ranges of the present invention, the tensile strengths were high and the conductivities were sufficiently ensured.

Particularly, in Example of Present Invention 1, the copper alloy wire had the same strength as that of the Conventional Example manufactured using a manufacturing method including a hot extrusion step. Meanwhile, FIGS. 3 and 4 show that, in the Conventional Example, the segregations of Co and P were eliminated; however, in Conventional Example 1, the segregations of Co and P were not eliminated. It was confirmed that, in Example of Present Invention 1, sufficient strength could be obtained even though the segregations were not eliminated.

In addition, in Examples of Present Invention 1 to 3 in which the atomic ratio Co/P of Co to P is set in a range of $1.2 \leq Co/P \leq 1.7$, it was confirmed that the strength was further improved than in Examples of Present Invention 4 and 5.

Furthermore, in Examples of Present Invention 6 to 9 including Ni, Fe, Zn, Mg, Ag, and Zr, it was confirmed that the strength was further improved than in copper alloy wires not including these elements.

In addition, in Examples of Present Invention 10 to 13 in which the amount of Sn was great, the conductivity was slightly low, but the strength was significantly improved.

From the above-described facts, it was confirmed that, according to the present invention, even in a case in which a copper alloy wire made of a precipitation hardening-type copper alloy containing Co, P, and Sn was manufactured using the continuous cast-rolling method, the same strength as that of a copper alloy wire manufactured using a manufacturing method including a hot extrusion step could be obtained.

Example 2

Examples of Present Invention 21 to 28

Continuous cast wire rods (with an outer diameter of 25 mm) made of a copper alloy having a composition shown in Table 3 were produced using an upward continuous caster. Primary cold working was carried out on these continuous cast wire rods so as to reduce the outer diameter to 18 mm, and then an aging heat treatment was carried out under conditions of 500° C. and four hours. After that, secondary cold working was carried out, thereby reducing the outer diameter to 12 mm.

(Examples of Present Invention 31 to 38)

Continuous cast wire rods (with an outer diameter of 25 mm) made of a copper alloy having a composition shown in Table 3 were produced using a horizontal continuous caster. Primary cold working was carried out on these continuous cast wire rods so as to reduce the outer diameter to 18 mm, and then an aging heat treatment was carried out under conditions of 500° C. and four hours. After that, secondary cold working was carried out, thereby reducing the outer diameter to 12 mm.

(Examples of Present Invention 41 to 48)

Continuous cast wire rods (with an outer diameter of 25 mm) made of a copper alloy having a composition shown in Table 3 were produced using a hot top continuous caster. Primary cold working was carried out on these continuous cast wire rods so as to reduce the outer diameter to 18 mm, and then an aging heat treatment was carried out under conditions of 500° C. and four hours. After that, secondary cold working was carried out, thereby reducing the outer diameter to 12 mm.

The tensile strengths and conductivities of the copper alloy wires obtained as described above were evaluated as described below under the same conditions as in Example 1. The evaluation results are shown in Table 3.

TABLE 3

| | | Alloy component composition | | | | | | | Evaluation | |
|---|---|---|---|---|---|---|---|---|---|---|
| | | Co mass % | P mass % | Sn mass % | Co/P Atomic ratio | (Co + P)/Sn Atomic ratio | Cu | Step Casting step | Tensile strength MPa | Conductivity % IACS |
| Examples of Present Invention | 21 | 0.215 | 0.104 | 0.473 | 1.089 | 1.777 | Balance | Upward continuous casting | 570 | 79 |
| | 22 | 0.224 | 0.133 | 0.439 | 0.887 | 2.212 | Balance | Upward continuous casting | 574 | 78 |
| | 23 | 0.333 | 0.106 | 0.493 | 1.655 | 2.208 | Balance | Upward continuous casting | 582 | 75 |
| | 24 | 0.310 | 0.143 | 0.457 | 1.142 | 2.593 | Balance | Upward continuous casting | 584 | 77 |
| | 25 | 0.205 | 0.105 | 0.049 | 1.029 | 16.814 | Balance | Upward continuous casting | 552 | 81 |
| | 26 | 0.209 | 0.145 | 0.015 | 0.759 | 65.782 | Balance | Upward continuous casting | 557 | 80 |
| | 27 | 0.340 | 0.109 | 0.028 | 1.643 | 39.801 | Balance | Upward continuous casting | 563 | 77 |
| | 28 | 0.332 | 0.144 | 0.048 | 1.215 | 25.698 | Balance | Upward continuous casting | 569 | 77 |
| | 31 | 0.225 | 0.105 | 0.476 | 1.129 | 1.816 | Balance | Transverse continuous casting | 571 | 78 |
| | 32 | 0.213 | 0.135 | 0.465 | 0.831 | 2.056 | Balance | Transverse continuous casting | 575 | 78 |
| | 33 | 0.326 | 0.107 | 0.455 | 1.605 | 2.370 | Balance | Transverse continuous casting | 580 | 75 |
| | 34 | 0.310 | 0.134 | 0.432 | 1.219 | 2.662 | Balance | Transverse continuous casting | 582 | 75 |
| | 35 | 0.213 | 0.098 | 0.042 | 1.145 | 19.359 | Balance | Transverse continuous casting | 551 | 81 |
| | 36 | 0.221 | 0.136 | 0.040 | 0.856 | 24.409 | Balance | Transverse continuous casting | 558 | 80 |
| | 37 | 0.330 | 0.108 | 0.041 | 1.610 | 26.590 | Balance | Transverse continuous casting | 562 | 78 |
| | 38 | 0.337 | 0.142 | 0.046 | 1.250 | 26.869 | Balance | Transverse continuous casting | 569 | 77 |
| | 41 | 0.205 | 0.097 | 0.481 | 1.113 | 1.648 | Balance | Hot top continuous casting | 569 | 79 |
| | 42 | 0.212 | 0.146 | 0.476 | 0.765 | 2.094 | Balance | Hot top continuous casting | 568 | 78 |
| | 43 | 0.340 | 0.102 | 0.491 | 1.756 | 2.215 | Balance | Hot top continuous casting | 582 | 76 |

TABLE 3-continued

| | Alloy component composition | | | | | | | Evaluation | |
|---|---|---|---|---|---|---|---|---|---|
| | Co mass % | P mass % | Sn mass % | Co/P Atomic ratio | (Co + P)/Sn Atomic ratio | Cu | Step Casting step | Tensile strength MPa | Conductivity % IACS |
| 44 | 0.343 | 0.139 | 0.484 | 1.300 | 2.555 | Balance | Hot top continuous casting | 588 | 75 |
| 45 | 0.222 | 0.098 | 0.013 | 1.193 | 63.956 | Balance | Hot top continuous casting | 569 | 79 |
| 46 | 0.205 | 0.144 | 0.023 | 0.750 | 42.379 | Balance | Hot top continuous casting | 570 | 78 |
| 47 | 0.322 | 0.099 | 0.040 | 1.714 | 25.977 | Balance | Hot top continuous casting | 582 | 76 |
| 48 | 0.342 | 0.140 | 0.031 | 1.287 | 39.949 | Balance | Hot top continuous casting | 588 | 75 |

As shown in Table 3, even in the copper alloy wires manufactured by producing the continuous cast wire rod using the upward continuous caster, the horizontal continuous caster, and the hot top continuous caster, and carrying out cold working on these copper alloy wires without carrying out hot working, it was confirmed that the tensile strengths were high and the conductivities were sufficiently ensured.

Example 3

Examples of Present Invention 51 to 64

Next, as a copper alloy wire for, for example, a use requiring a high balance between the strength and the conductivity such as a wire harness, copper alloy wires in which (Co+P)/Sn was controlled were evaluated as shown in Table 4.

In Examples of Present Invention 51 to 55, similar to Examples of Present Invention 1 to 13 of Example 1, copper wire rods (with an outer diameter of 25 mm) were produced using a continuous cast-rolling facility provided with a belt wheel-type continuous caster, and primary cold working, a thermal treatment, and secondary cold working were carried out, thereby obtaining copper alloy wires (with an outer diameter of 12 mm) having a composition shown in Table 4.

In Examples of Present Invention 56 to 58, similar to Examples of Present Invention 21 to 28 of Example 2, continuous cast wire rods (with an outer diameter of 25 mm) made of a copper alloy having a composition shown in Table 4 were produced using the upward continuous caster, and primary cold working, a thermal treatment, and secondary cold working were carried out, thereby obtaining copper alloy wires (with an outer diameter of 12 mm) having a composition as shown in Table 4.

In Examples of Present Invention 59 to 61, similar to Examples of Present Invention 31 to 38 of Example 2, continuous cast wire rods (with an outer diameter of 25 mm) made of a copper alloy having a composition shown in Table 4 were produced using the horizontal continuous caster, and primary cold working, a thermal treatment, and secondary cold working were carried out, thereby obtaining copper alloy wires (with an outer diameter of 12 mm) having a composition as shown in Table 4.

In Examples of Present Invention 62 to 64, similar to Examples of Present Invention 41 to 48 of Example 2, continuous cast wire rods (with an outer diameter of 25 mm) made of a copper alloy having a composition shown in Table 4 were produced using the hot top continuous caster, and primary cold working, a thermal treatment, and secondary cold working were carried out, thereby obtaining copper alloy wires (with an outer diameter of 12 mm) having a composition shown in Table 4.

TABLE 4

| | | Alloy component composition | | | | | | | Evaluation | |
|---|---|---|---|---|---|---|---|---|---|---|
| | | Co mass % | P mass % | Sn mass % | Co/P Atomic ratio | (Co + P)/Sn Atomic ratio | Cu | Step Casting step | Tensile strength MPa | Conductivity % IACS |
| Examples of Present Invention | 51 | 0.298 | 0.106 | 0.153 | 1.413 | 5.447 | Balance | Continuous cast-rolling | 575 | 80 |
| | 52 | 0.303 | 0.118 | 0.173 | 1.353 | 6.207 | Balance | Continuous cast-rolling | 578 | 79 |
| | 53 | 0.305 | 0.111 | 0.203 | 1.448 | 5.177 | Balance | Continuous cast-rolling | 578 | 79 |
| | 54 | 0.212 | 0.097 | 0.220 | 1.151 | 3.669 | Balance | Continuous cast-rolling | 568 | 81 |
| | 55 | 0.346 | 0.143 | 0.152 | 1.275 | 8.277 | Balance | Continuous cast-rolling | 584 | 78 |
| | 56 | 0.311 | 0.109 | 0.157 | 1.503 | 6.722 | Balance | Upward continuous casting | 578 | 79 |
| | 57 | 0.302 | 0.106 | 0.180 | 1.501 | 5.697 | Balance | Upward continuous casting | 576 | 80 |
| | 58 | 0.292 | 0.117 | 0.208 | 1.315 | 5.036 | Balance | Upward continuous casting | 578 | 79 |
| | 59 | 0.304 | 0.103 | 0.158 | 1.555 | 6.442 | Balance | Transverse continuous casting | 574 | 79 |
| | 60 | 0.308 | 0.115 | 0.170 | 1.411 | 6.308 | Balance | Transverse continuous casting | 577 | 79 |
| | 61 | 0.290 | 0.111 | 0.209 | 1.376 | 4.882 | Balance | Transverse continuous casting | 577 | 79 |
| | 62 | 0.292 | 0.116 | 0.155 | 1.326 | 6.734 | Balance | Hot top continuous casting | 575 | 79 |
| | 63 | 0.305 | 0.115 | 0.174 | 1.397 | 6.128 | Balance | Hot top continuous casting | 577 | 79 |
| | 64 | 0.290 | 0.098 | 0.202 | 1.559 | 4.802 | Balance | Hot top continuous casting | 574 | 79 |

In Examples of Present Invention 51 to 64 in which (Co+P)/Sn was set to be in a range of $3.5 \leq (Co+P)/Sn \leq 8.5$, it was confirmed that all of the copper alloy wires had high tensile strengths and high conductivities and could be applied to, for example, the use requiring high strength and high conductivity such as a wire harness.

REFERENCE SIGNS LIST

S01 CONTINUOUS CAST-ROLLING STEP

The invention claimed is:

1. A copper alloy wire which is made of a precipitation hardening-type copper alloy, said copper alloy wire comprising:

Co;

P; and

Sn, wherein the copper alloy is manufactured using a continuous cast-rolling method or cold working of a continuous cast wire rod manufactured using a continuous casting method, wherein the copper alloy wire has a composition including Co: more than or equal to 0.20 mass % and less than or equal to 0.35 mass %, P: more than 0.095 mass % and less than or equal to 0.15 mass %, and Sn: more than or equal to 0.01 mass % and less than or equal to 0.5 mass % with a balance being Cu and inevitable impurities, wherein an atomic ratio Co/P of Co to P is set to be in a range of $1.3 \leq Co/P \leq 1.7$, wherein a conductivity of the copper alloy wire is 75% IACS or more and 81% IACS or less, and a tensile strength of the copper alloy is 554 MPa or more and 584 MPa or less.

2. The copper alloy wire according to claim 1, further comprising one or more elements selected from a group consisting of Ni: more than or equal to 0.01 mass % and less than or equal to 0.15 mass %; and Fe: more than or equal to 0.005 mass % and less than or equal to 0.07 mass %.

3. The copper alloy wire according to claim 1, further comprising one or more elements selected from a group consisting of Zn: more than or equal to 0.002 mass % and less than or equal to 0.5 mass %; Mg: more than or equal to 0.002 mass % and less than or equal to 0.25 mass %; Ag: more than or equal to 0.002 mass % and less than or equal to 0.25 mass %; and Zr: more than or equal to 0.001 mass % and less than or equal to 0.1 mass %.

4. The copper alloy wire according to claim 1, wherein an atomic ratio (Co+P)/Sn is set in a range of $3.5 \leq (Co+P)/Sn \leq 8.5$.

5. The copper alloy wire according to claim 1, wherein the copper alloy wire is produced by a continuous cast-rolling step, followed by a primary cold working step, an aging heat treatment step and a secondary cold working step.

6. The copper alloy wire according to claim 5, wherein the primary cold working is carried out on copper wire rods so as to reduce an outer diameter of the copper rods to 18 mm.

* * * * *